US006334320B1

(12) United States Patent
Brown et al.

(10) Patent No.: US 6,334,320 B1
(45) Date of Patent: Jan. 1, 2002

(54) ELECTRONIC MANIFOLD FOR A REFRIGERANT SERVICING UNIT

(75) Inventors: William C. Brown, Bryan; James P. Biedenharn, Edgerton, both of OH (US)

(73) Assignee: SPX Corporation, Muskegon, MI (US)

( * ) Notice: Subject to any disclaimer, the term of this patent is extended or adjusted under 35 U.S.C. 154(b) by 0 days.

(21) Appl. No.: 09/537,539

(22) Filed: Mar. 29, 2000

Related U.S. Application Data

(60) Provisional application No. 60/126,961, filed on Mar. 30, 1999.

(51) Int. Cl.[7] ..... F25B 45/00
(52) U.S. Cl. ..... 62/149; 62/292
(58) Field of Search ..... 62/292, 149

(56) References Cited

U.S. PATENT DOCUMENTS 5,056,560 A 10/1991 DeMartelaere
5,080,131 A 1/1992 Manz et al.
5,231,841 A * 8/1993 McClelland et al. ..... 62/77
5,248,125 A 9/1993 Fritch et al.
5,317,903 A * 6/1994 McClelland et al. ..... 62/77
6,016,661 A * 1/2000 Sagar ..... 62/149
6,101,822 A * 8/2000 Groves ..... 62/149
6,119,475 A * 9/2000 Murray et al. ..... 62/292
6,134,896 A * 10/2000 Brown et al. ..... 62/149
6,134,899 A * 10/2000 Brown et al. ..... 62/195
6,138,462 A * 10/2000 Murray et al. ..... 62/149

* cited by examiner

*Primary Examiner*—Henry Bennett
*Assistant Examiner*—Mark Shulman
(74) *Attorney, Agent, or Firm*—Baker & Hostetler LLP; Ken J. Sheehan

(57) ABSTRACT

A manifold having an electrical pressure transducer which is coupled to a diagnostic instrument. In a preferred embodiment, a pressure transducer is incorporated in the manifold which has one end which threads directly onto the refrigeration unit. The manifold also has a coupling to which a servicing hose can be coupled for recharging the refrigeration unit.

11 Claims, 3 Drawing Sheets

ELECTRONIC MANIFOLD FOR A REFRIGERANT SERVICING UNIT

CROSS-REFERENCE TO RELATED APPLICATION

This application claims priority under 35 U.S.C. §1.119 (e) on U.S. Provisional Application No. 60/126,961 entitled ELECTRONIC MANIFOLD FOR A REFRIGERANT SERVICING UNIT, filed on Mar. 30, 1999, by William C. Brown and James P. Biedenharn, the entire disclosure of which is incorporated herein by reference.

BACKGROUND OF THE INVENTION

The present invention relates to an electronic refrigeration servicing unit and particularly to an improved manifold for coupling the unit to a refrigeration circuit.

Typically, when servicing refrigeration circuits, it is necessary to use manifold gauges which are coupled to the refrigeration circuit utilizing hoses for the high and low pressure sides of the system. The hoses typically are five to six feet in length and, therefore, have a significant interior volume. Small refrigerant systems, such as ice makers and the like, utilize a relatively small amount of refrigerant and the coupling of hoses leading to servicing gauges itself causes a loss of refrigerant from the system which can be sufficient to require recharging. Thus, when testing a refrigerant circuit, it is possible that the testing procedure itself adversely affects a system which may otherwise have been fully charged by leaking refrigerant into the hoses such that recharging becomes necessary. Also, with relatively long hoses, refrigerant is lost to the atmosphere during servicing, which is undesirable in view of environmental concerns. Such hoses, when used with the variety of different refrigerants now in common use, can also cause cross contamination of refrigerants and their associated lubricants.

SUMMARY OF THE INVENTION

The system of the present invention eliminates the need for lengthy hoses by providing a manifold having an electrical pressure transducer which is coupled to electrical displays, thereby eliminating the need for conventional pressure gauges with hoses attached to the refrigeration circuit. In a preferred embodiment of the invention, a pressure transducer is incorporated in a manifold with one end which threads directly onto the refrigeration unit. The manifold also has a coupling which allows attachment of a servicing hose for recharging the refrigeration unit, if necessary.

Thus, with the system of the present invention, the pressure of a refrigeration circuit can be monitored without any significant refrigerant loss and, if further servicing is necessary, allows the coupling of a vacuum pump and a refrigerant source directly to the refrigerant circuit and continuous monitoring of the system during servicing. As a result, the risk of cross-mixing refrigerants is eliminated which could occur with conventional hoses employed for servicing different units having different refrigerants. Loss of refrigerant when servicing small units is minimized. Also, there is little or no venting of refrigerant from hoses to the environment. The electrical leads from the transducers to the hand-held electronic diagnostic unit are flexible and lightweight and, therefore, easy to handle, store and maneuver in tight places encountered in servicing refrigeration units.

These and other features, objects and advantages of the present invention will become apparent upon reading the following description thereof together with reference to the accompanying drawings.

DETAILED DESCRIPTION OF THE PREFERRED EMBODIMENT

Figure 1:
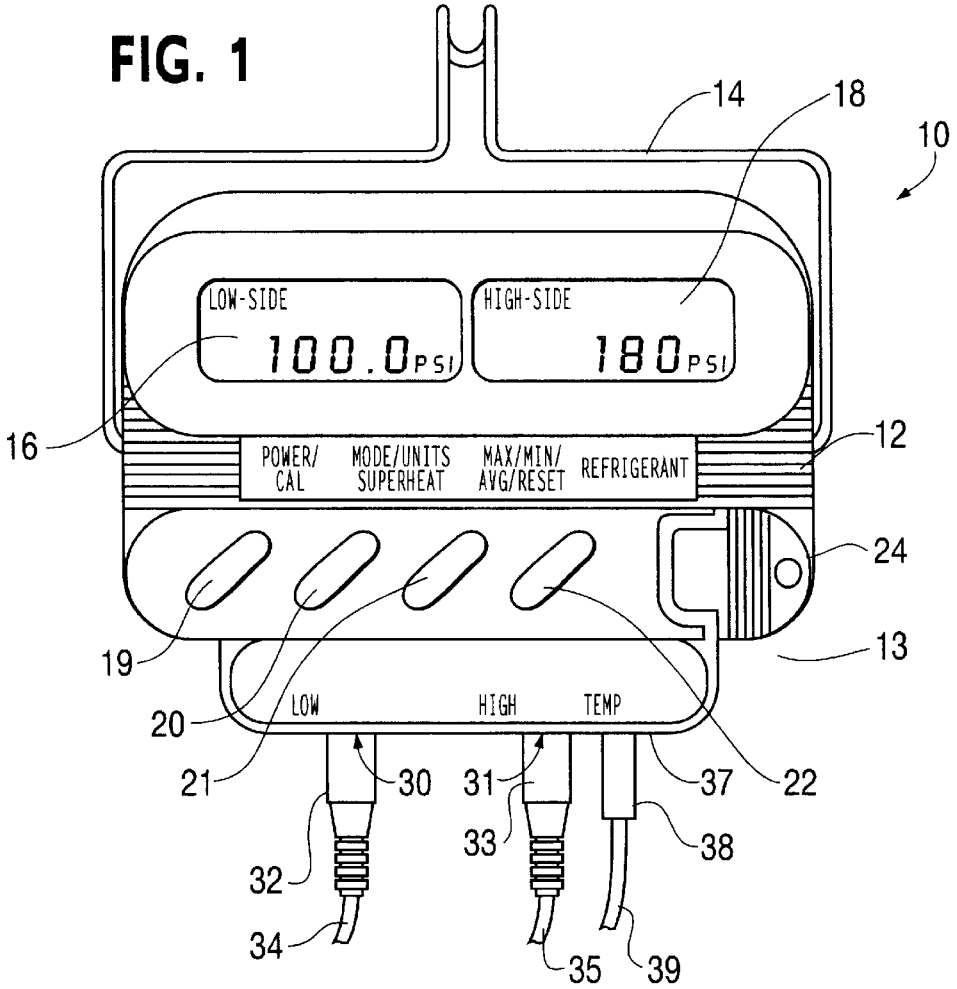
FIG. 1 is a front elevational view of a servicing unit embodying the present invention.
Figure 2:
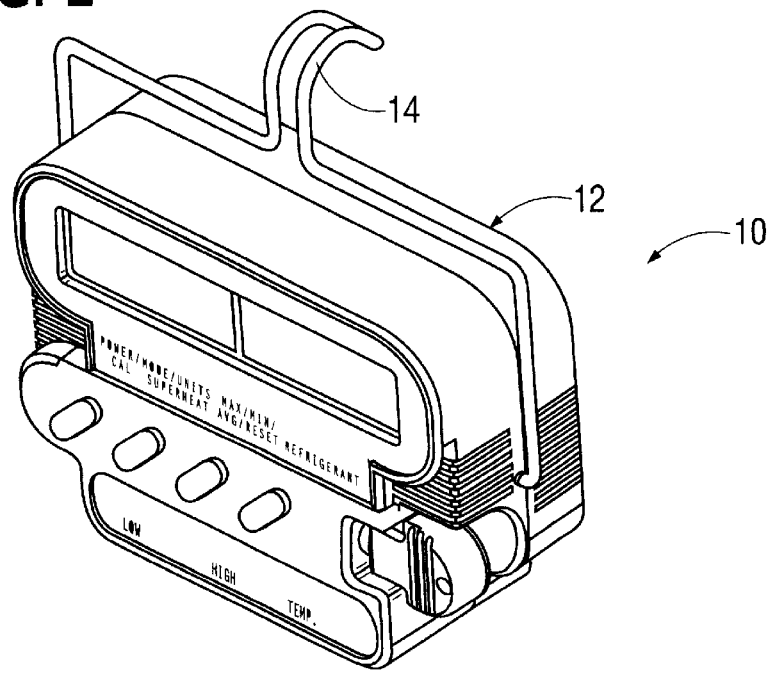
FIG. 2 is a perspective view of the servicing unit shown in FIG. 1.

Referring initially to FIGS. 1 and 2, there is shown the hand-held electronic diagnostic unit 10 of the present invention including a housing 12, which can be held in a person's hand 13. Housing 12 includes a wire hanger 14 for alternatively hooking the instrument at a convenient location during servicing of a refrigeration circuit. The unit 10 includes a display panel 16 for the low pressure side and a display panel 18 for the high pressure side, as well as control switches 19–22 for controlling the power for the unit, the mode of operation, the stored pressure information, and resetting the pressure displays. Housing 12 also includes a socket for receiving one of several refrigerant identification keys 24, each of which includes a ROM memory with a table programmed for pressure and temperatures for a given refrigerant. The memory is coupled to a microprocessor contained within the servicing unit 10 to calibrate the instrument for a particular type of refrigerant.

In addition, the housing 12 includes a first socket 30 for receiving a plug 32 coupled to an electrical conductor 34 leading to a pressure transducer or sensor 36 (FIG. 3), as described in greater detail below. The housing also includes a second socket 31 for receiving plug 33 coupled to conductor 35 also coupled to another pressure sensor for the high pressure side of the refrigeration circuit being serviced. Finally, housing 12 includes an additional socket 37 for receiving a plug 38 coupled to a conductor 39 leading to a temperature probe which can be attached to the refrigeration circuit for reading ambient, suction line, shell, evaporator, or condenser temperatures during a servicing cycle.

The housing 12 is relatively compact, as seen in FIG. 1, and can be hand-held or hooked utilizing the wire hanger 14 to the refrigeration unit being serviced. The display contained within the housing 10, the microprocessor and its programming forms no part of the present invention other than to utilize the electrical signals from the unique manifolds 50 (FIGS. 3–5) employed for low side and high side pressure sensing, as now described in connection with FIGS. 3–5.

Figure 3:
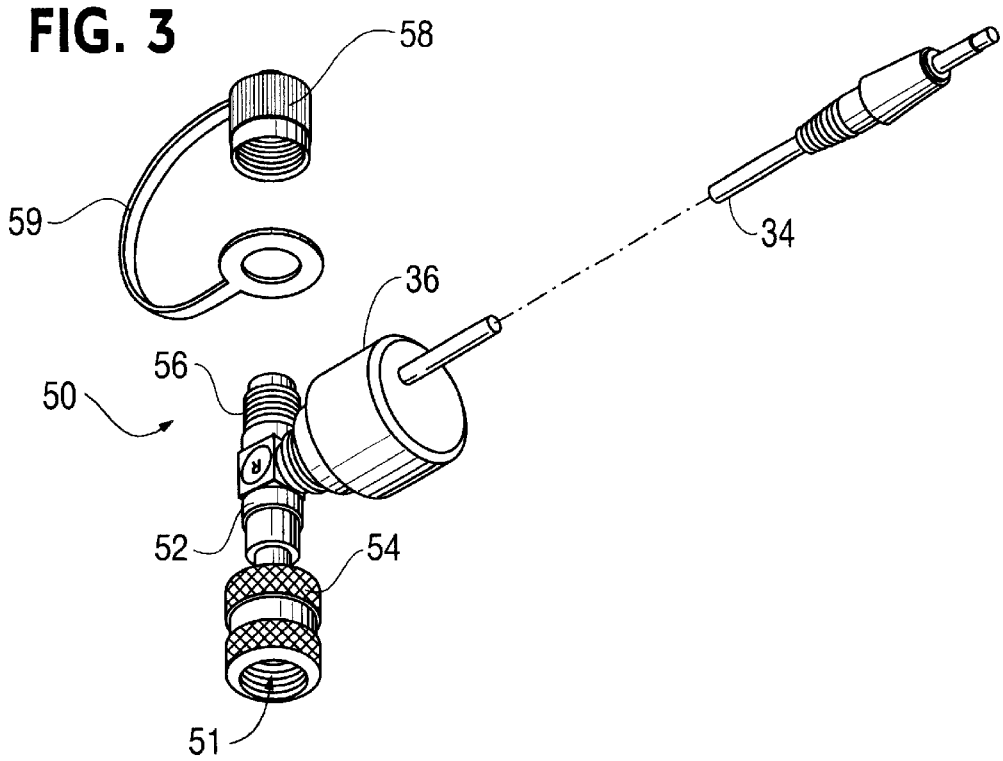
FIG. 3 is a partly exploded perspective view of a manifold and electrical connection from the pressure transducer contained therein to the service unit shown in FIGS. 1 and 2.
Figure 4:
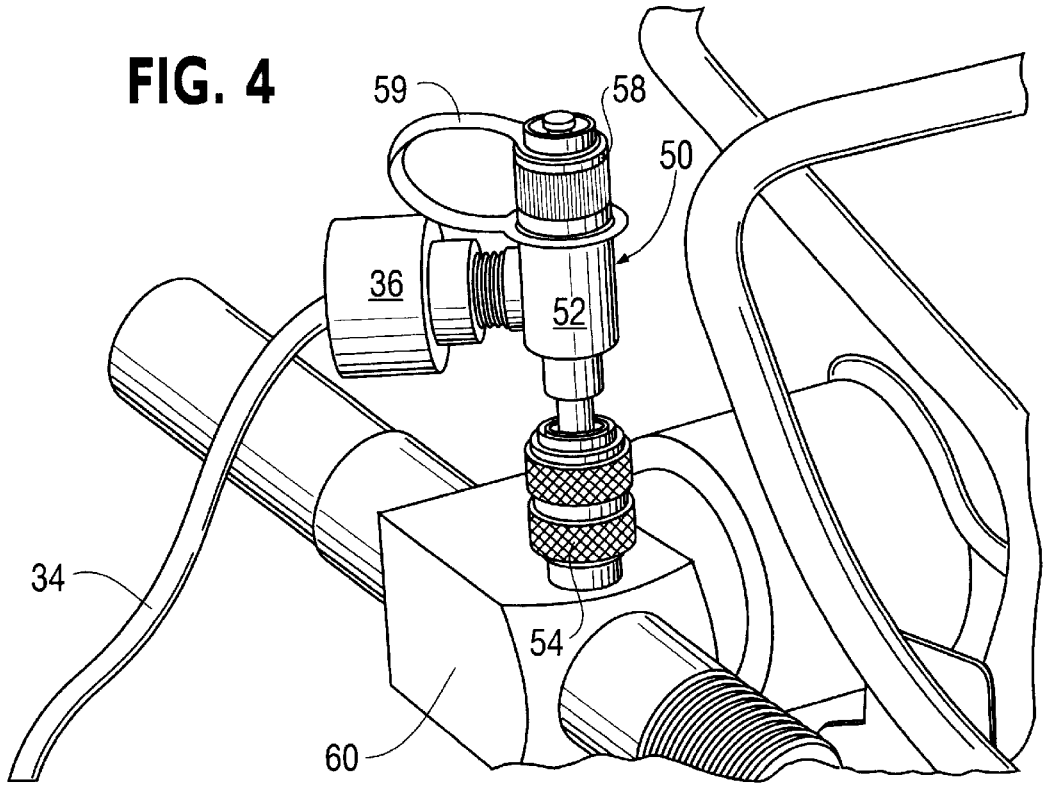
FIG. 4 is a perspective view of the manifold shown in FIG. 3, shown coupled to a refrigeration circuit for monitoring the pressure of the system.

Referring to FIG. 3, there is shown a generally T-shaped manifold 50 which includes a body 52 having a conventional electrically actuated pressure transducer 36 threaded into the center thereof and communicating with the interior space 51 of the manifold 50. One end of the manifold 50 includes a female threaded coupling 54 for attachment of the manifold to a nipple on the refrigerant circuit being serviced, as illustrated in FIG. 4. Coupling 54 is conventionally rotatably mounted to the manifold utilizing a suitable seal and gasket to allow its knurled outer surface to be rotated for attaching the manifold 50 in sealing engagement with the refrigeration unit. The end of manifold 50 opposite coupling 54 includes a male threaded quarter-inch flare-type coupling 56 internally including a Schraeder valve near such coupling for sealing the coupling 56 until such time as refrigerant is to be passed through the coupling. A sealed end cap 58 is tethered to the coupling 56 by means of a strap 59.

In use, a pair of the manifolds 50 integrally including pressure transducers 36 are attached to the high and low side of the refrigerant circuit 60 (one transducer is shown in FIG. 4) utilizing the threaded coupling 54. The electrical conductor 34 for each of the pressure transducers is then extended from the refrigerant circuit and plugged into the sockets 30 and 31 of the servicing unit 10 as illustrated in FIG. 1 for receiving operating power and providing pressure representative signals to unit 10. For servicing requiring temperature measurements, the temperature probe is also plugged into the unit 10 utilizing plug 38 and socket 37. The servicing unit is then operated in a normal fashion through the sequence of pressure and temperature measurements to determine whether additional refrigerant is required or the system needs to be otherwise serviced.

Figure 5:
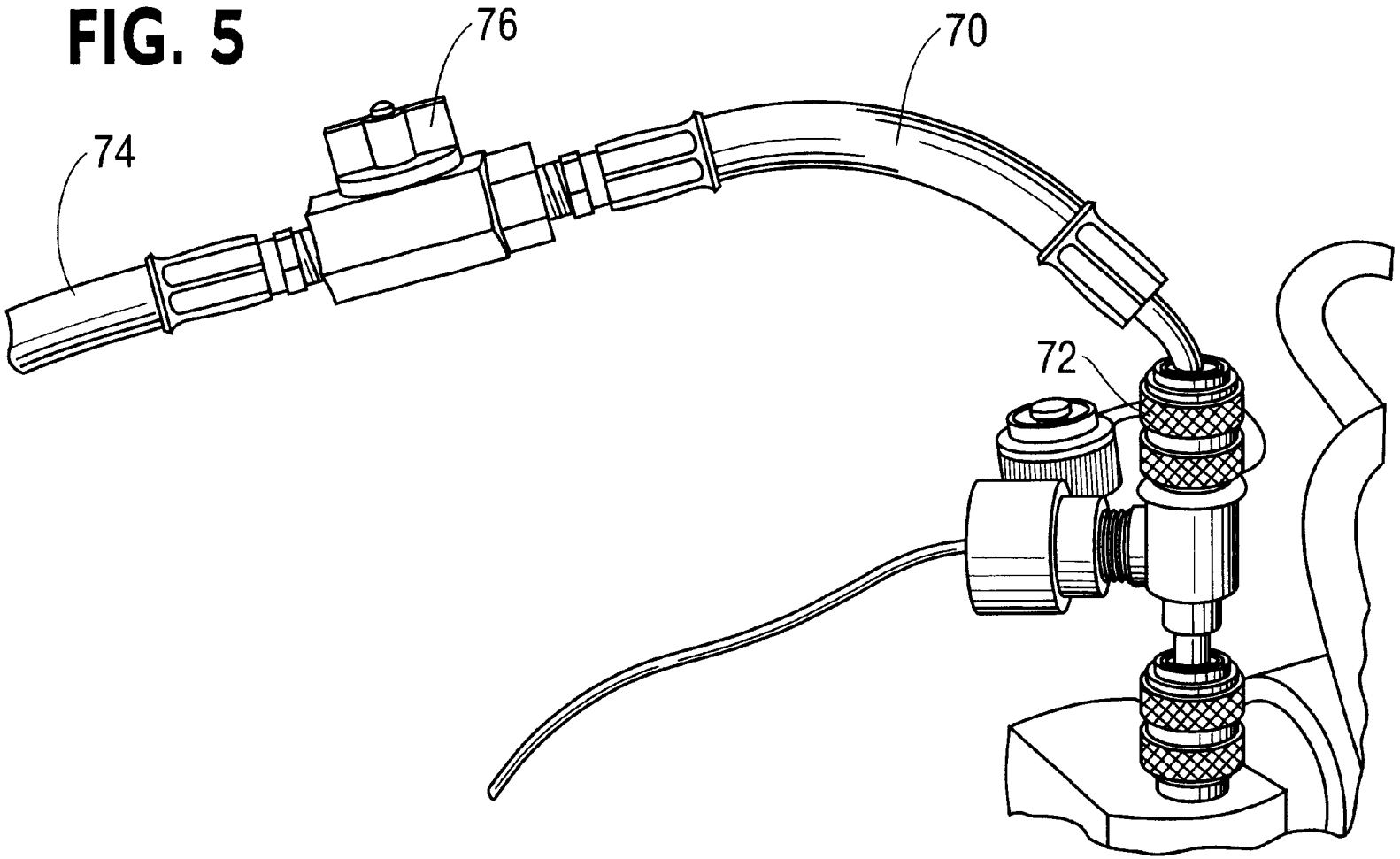
FIG. 5 is a perspective view of the manifold shown in FIGS. 3–4, shown with a servicing hose coupled thereto for adding refrigerant or for evacuating the system.

If additional refrigerant is required, on either the high end or the low end of the system, as illustrated in FIG. 5, the protective cap 58 is removed from the manifold 50 and a service hose 70 is attached to the coupling 56 utilizing a standard threaded coupling 72. Hose 70 is coupled to a supply hose 74 through a valve 76. The valve is actuated while the service personnel monitors the pressure until a desired amount of refrigerant has been added to either the high side or the low side. As can be seen with the system of the present invention, only the T-shaped manifolds 50 are attached to the refrigeration circuit for purposes of monitoring the pressures, thus eliminating the hoses typically associated with servicing units and the accompanying loss of refrigerant, cross contamination and other problems associated with servicing hoses. The remote commercially available pressure sensors are integrally installed in the manifolds 50 such that a convenient coupling is also provided for the addition of refrigerant, as illustrated in FIG. 5, or for the evacuation of the refrigeration circuit utilizing a vacuum pump. Such a system, therefore, greatly simplifies the servicing of a refrigeration circuit and, particularly where small charges of refrigerant are employed, prevents unnecessary escape and loss of refrigerant.

It will become apparent to those skilled in the art that various modifications to the preferred embodiment of the invention can be made without departing from the spirit or scope of the invention as defined by the appended claims.

The invention claimed is:

1. A manifold for use with a refrigerant servicing unit comprising:

a generally T-shaped manifold body having a coupling at a first end for threadably attaching to a coupling of a refrigeration circuit;

an electrical pressure transducer mounted to said body and communicating with the interior space of said manifold body;

said body further including a second coupling at a second end communicating with the interior of said manifold body for receiving a refrigerant charging hose;

said pressure transducer is intermediate said first end and said second end;

said manifold body includes a valve extending between said first and said second end and;

said manifold further includes a cap threadably mounted to said second end.

2. The manifold as defined in claim 1 and further including an electrical conductor extending from said pressure transducer and terminating in a plug for insertion into a service instrument.

3. An instrument for servicing a refrigerant circuit comprising:

a housing including a display for displaying high and low pressure conditions of a refrigerant circuit at high pressure and low pressure sides; and a pair of electronic pressure gauges, each pressure gauge including a generally T-shaped body having a first coupling for threadably attaching to a coupling of a refrigeration circuit, an electrical pressure transducer mounted to said body and communicating with the interior space of said body, said body further including a second threaded coupling communicating with the interior of said body for selectively receiving a refrigerant charging hose, said body includes a valve extending between said first coupling and said second coupling, said second coupling further includes a cap threadably mounted to said second coupling, wherein said pressure transducer is intermediate said first coupling and said second coupling.

4. The instrument as defined in claim 3 and further including an electrical conductor extending from each of said pressure transducers and terminating in a plug.

5. The instrument as defined in claim 3 and further including an electrical temperature sensor coupled to said instrument.

6. A coupling for use with a refrigerant servicing unit comprising:

a generally T-shaped body having a first coupling for attaching to a coupling of a refrigeration circuit;

an electrical pressure transducer mounted to said body and communicating with the interior space of said body; and said body further including a second coupling communicating with the interior of said body for selectively receiving one of a refrigerant charging hose or vacuum pump hose; wherein said pressure transducer is intermediate said first coupling and said second coupling.

7. The coupling as defined in claim 6 and further including an electrical conductor extending from said pressure transducer and terminating in a plug for insertion into a service instrument.

8. The coupling as defined in claim 7 wherein said body includes a valve extending between said first coupling and said second coupling.

9. The coupling as defined in claim 8 wherein said second coupling further includes a cap threadably mounted to said second coupling.

10. An instrument for servicing a refrigerator circuit comprising:

a display for displaying high and low pressure conditions of a refrigerant circuit at high pressure and low pressure sides; and a pair of electronic pressure sensors electrically coupled to said display, said sensors adapted to be mounted to a refrigeration unit to be serviced for detecting and displaying the refrigerant pressure therein, each pressure sensor including a generally T-shaped body having a first coupling for threadably attaching to a coupling of a refrigeration circuit, an electrical pressure transducer mounted to said body and communicating with the interior space of said body, and said body further including a second coupling communicating with the interior of said body for selectively receiving a refrigerant charging hose, wherein said pressure transducer is intermediate said first coupling and said second coupling.

11. The instrument as defined in claim 10 wherein said body includes a valve extending between said first coupling and said second coupling.

* * * * *